US005285914A

United States Patent [19]

Del Zotto

[11] Patent Number: 5,285,914

[45] Date of Patent: Feb. 15, 1994

[54] ABOVE-GRADE STORAGE VAULT

[76] Inventor: William M. Del Zotto, 2300 Commonwealth Ave., Duluth, Minn. 55808-1699

[21] Appl. No.: 980,755

[22] Filed: Nov. 24, 1992

[51] Int. Cl.[5] ..... B65D 88/76

[52] U.S. Cl. ..... 220/4.12; 220/571; 220/445; 220/410

[58] Field of Search ..... 220/445, 4.12, 571, 220/468, 415, 694, 410

[56] References Cited

U.S. PATENT DOCUMENTS

| | | | |
|---|---|---|---|
| 2,777,295 | 1/1957 | Bliss et al. | 220/445 |
| 3,511,003 | 5/1970 | Alleaume | 220/445 |
| 3,775,251 | 11/1973 | Schabert | 220/445 |
| 4,041,722 | 8/1977 | Terlesky et al. | 220/445 |
| 4,315,388 | 2/1982 | Ramseyer | 220/445 |
| 4,911,326 | 3/1990 | McGouran, Jr. | 220/445 |
| 4,960,222 | 10/1990 | Fields, III | 220/445 |
| 5,071,166 | 12/1991 | Marino | 220/445 |
| 5,082,138 | 1/1992 | McGarvey | 220/445 |
| 5,110,006 | 5/1992 | Becker et al. | 220/445 |

*Primary Examiner*—Joseph Man-Fu Moy
*Attorney, Agent, or Firm*—Douglas L. Tschida

[57] ABSTRACT

Liquid containment apparatus comprising a metal storage tank mounted within a liquid impermeable, cast concrete vault. An open-topped, reinforced cast concrete vault base includes an internal thermal liner, liquid impermeable membrane, vault seal, tank cradles and support legs. Sloped interior walls, a sump and siphon facilitate liquid and/or condensate removal from the base. A vault cover is integrally cast with the tank and supports a number of projecting fill, vent, gauge, inspection, and siphon standpipes. Chamfered edges at the cover and lift hooks facilitate cover removal, alignment and tank inspection.

19 Claims, 4 Drawing Sheets

ABOVE-GRADE STORAGE VAULT

BACKGROUND OF THE INVENTION

The present invention relates to liquid storage vessels and, in particular, to an above-grade multi-sectioned cast concrete containment vessel which includes a primary, metal liquid storage container and intervening thermal liner and membrane liquid barrier.

A byproduct of society's increasing awareness of the environment and growing concerns regarding ground water contamination and the adverse effects of spilled petrochemicals (e.g. oil, gasoline etc.) has been the institution of varieties of regulatory controls. The containment tank of the present invention was developed to accommodate such regulations, especially for circumstances requiring above-grade storage of gasoline. A further purpose was to accommodate concerns of the user to cost and repair or replacement of portions of the containment system.

A variety of predecessor, below-grade storage systems have been developed for containing pressurized and non-pressurized, flammable liquids, such as gasoline, propane or natural gas. Some of such containment vessels or tanks are shown at U.S. Pat. Nos. 1,958,487; 3,151, 416; 3,995,472; 4,183,221; 4,607,522; and 4,653,312. The foregoing vessels generally provide tank constructions which include a primary metal containment chamber that is surrounded by a reinforcing material, such as concrete. Intervening layers of insulators and/or liquid impermeable materials are also disclosed in various arrangements.

Numerous above-grade storage vessels are also known. Historically, much such vessels provide only a single layer of material, such as metal or concrete, and thus the concern in the event of damage to the vessel. Some vessels, however, provide a multi-layered construction that includes a primary tank, which is surrounded by a concrete or metal structure. The primary tank may or may not be integrated into the surrounding structure. U.S. Pat. Nos. 2,083,491; 2,136,390; 2,777,295; and 4,513,550 disclose various layered cast concrete containment chambers wherein the structural walls include various liquid impermeable liners.

Still other above-grade composite vessels are disclosed at U.S. Pat. Nos. 2,544,828; 3,562,977; 4,366,654; 4,372,906; 4,552,166; 4,826,644; 4,934,122; and 4,986,436. Various of the foregoing storage vessels provide a primary metal containment chamber which is surrounded by a monolithic cast concrete structure. One or more intervening membranes, which are impermeable to the contained liquid, are also provided.

Deficiencies of the foregoing monolithic storage containers is that due to the above-grade containment environment, the tank is exposed to a variety of physical dangers which can affect the life of the storage tank. Such tanks are particularly subject to potential cracking with thermal expansion/contraction; physical damage due to handling or collision from automobiles or the like; and potential corrosion from condensates which form between the steel liner and surrounding concrete assembly. Damage to any one of the components can require replacement of the entire assembly.

In preference to a monolithic assembly, a modular assembly permits replacement of one or more of the containment components in the event of damage or normal wear and tear to portions of the storage vessel. A modular construction is also more accommodating of conventional manufacturing processes, such as are used to form multi-sectioned septic tanks having open-topped bases and detachable covers.

In appreciation of the foregoing deficiencies, the present invention provides a containment vessel, which lends itself to conventional pre-cast concrete construction technology. The vessel provides an improved, environmentally friendly containment structure for storing flammable liquids, such as gasoline, propane or the like.

SUMMARY OF THE INVENTION

It accordingly is a primary object of the present invention to provide an environmentally friendly, above-grade liquid containment vessel.

It is a further object of the invention to provide a vessel including a reinforced cast concrete vault for separately containing a primary liquid storage tank.

It is a further object of the invention to provide a sealed, multi-sectioned vault having a thermal liner or barrier to minimize condensation and a liquid impermeable membrane to prevent fumes and leakage in the event of rupture of a primary storage tank.

It is a further object of the invention to provide a cast concrete vault having a base which may include cradles for supporting a primary storage tank, a separate cover which is integrally secured to the primary tank at common reinforcement members cast as part of the cover and which cover includes seals that surround a number of standpipes which project from the tank through the cover.

It is a still further object of the invention to provide sump and siphon means communicating with the interior space of the vault base to facilitate removal of condensate or recovery of spilled liquid products.

Various of the foregoing objects, advantages and distinctions of the invention are obtained in a presently preferred construction which provides an open-topped, monolithically poured, reinforced cast concrete vault base and a removable, separately cast cover. The cover particularly includes an integrally cast, primary liquid storage tank. The base and cover are lined with a thermal barrier. The thermal barrier of the base is separately covered with a liquid impermeable membrane. The vault base may include internal tank cradles or the cradles may be secured to the primary tank.

The cover is integrally cast to common reinforcement members which project from a metal primary storage tank that mounts within the vault. The tank and cover assembly self-aligns to the vault base; and the vault base, cover and/or tank are separately replaceable.

Resilient seals are cast into the cover and surround a number of standpipes which project from the primary tank. Ones of the standpipes permit filling and venting of the primary tank. Others permit monitoring the liquid level and vault inspection, which is facilitated via adequate tank to vault spacings that permit visual inspection of all surfaces of the primary tank, while the cover is mounted in place. A separate seal is provided at the cover to base interface. Chamfered cover edges and lifting eyelets which are secured to the tank and project from the cover facilitate tank/cover removal or replacement.

The interior walls of the vault base are also sloped to relieve stresses encountered in climates exposed to potential freezing conditions and may include a sump space. A siphon assembly facilitates removal of condensate or liquid leakage. Support legs extend from the base to facilitate vault handling.

Still other objects, advantages and distinctions of the invention will become more apparent upon reference to the following detailed description with respect to the appended drawings. To the extent various modifications and improvements have been considered, they are described as appropriate. The invention should not however be interpreted in strict limitation to the provided description. Rather, the invention should be interpreted within the spirit and scope of the appended claims.

DESCRIPTION OF THE PREFERRED EMBODIMENT

Figure 1:
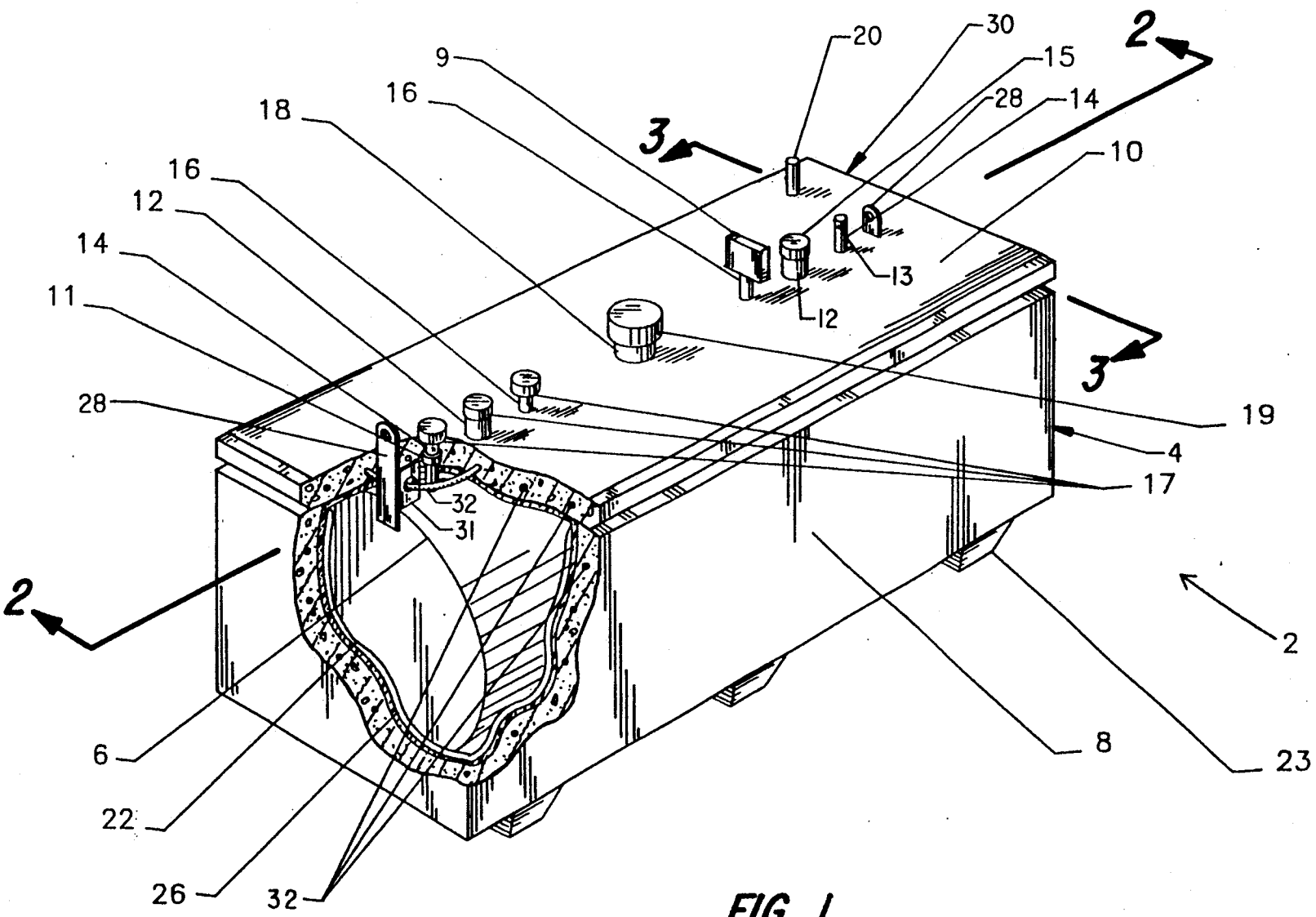
FIG. 1 is a perspective drawing shown in partial cutaway of the liquid containment vessel of the present invention.
Figure 2:
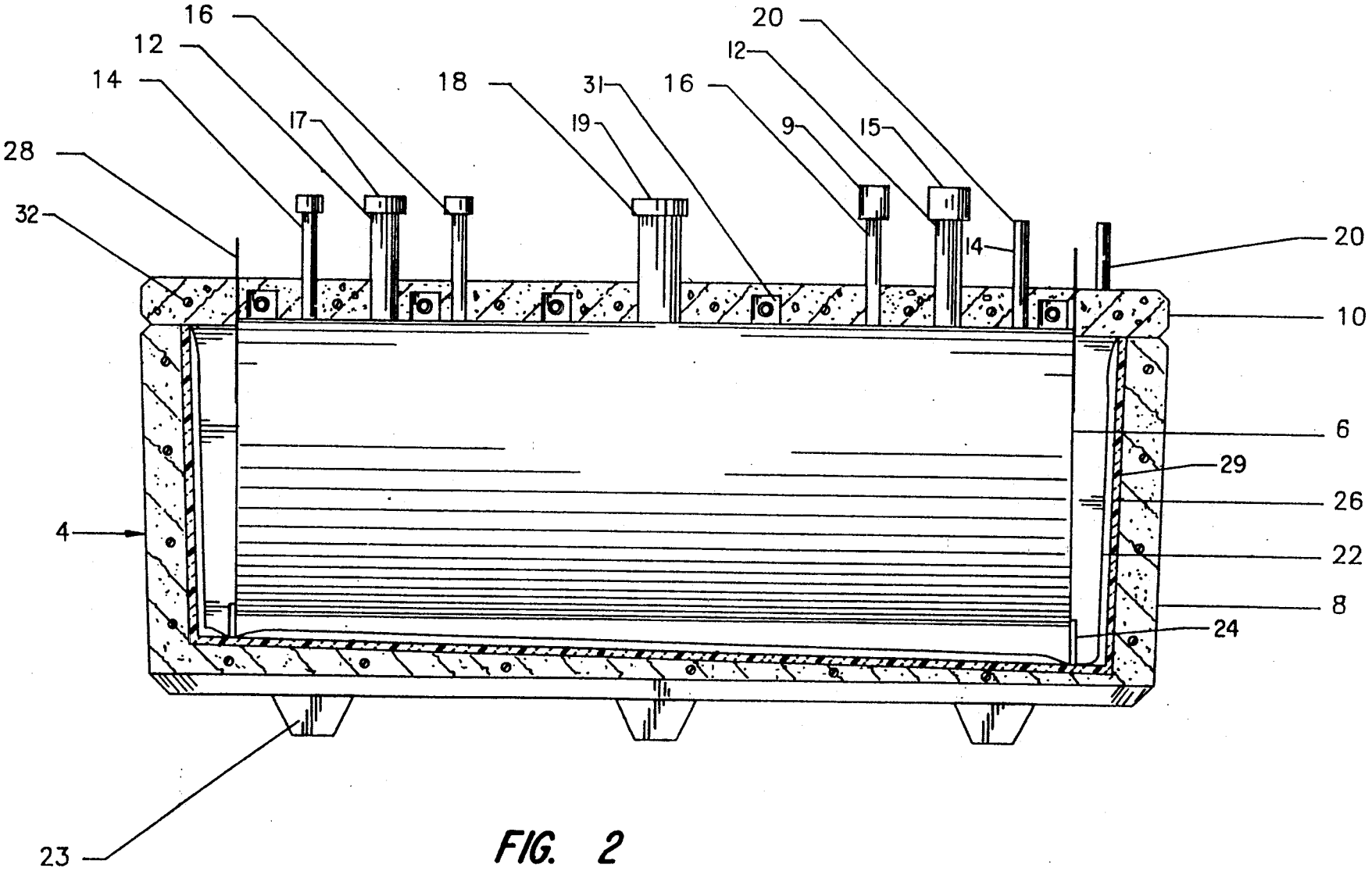
FIG. 2 is a cross section drawing taken along section lines 2—2 of FIG. 1.

Referring to FIGS. 1 and 2, FIG. 1 depicts an isometric drawing in partial cutaway of the environmentally friendly liquid storage vault or containment assembly 2 of the present invention. FIG. 2 depicts a section view taken along section lines 2—2. The assembly 2 generally includes a reinforced, cast concrete vault 4 which surrounds and contains a liquid impermeable container or tank 6. For the construction shown, the tank 6 is formed of metal; although could be constructed of any material impervious to the stored liquid and capable of sustaining the physical loading. The vault 4 includes an open-topped base 8 and a mating cover 10. The tank 6 and cover 10 are cast as an integral assembly 30, which is described in greater detail below.

Normally, the vault base 8 is sized to provide a capacity of 125 percent of the capacity of the tank 6. Complete containment of any spilled liquid is thereby achievable for any tank leak. Other capacities can be obtained with appropriate dimensional adjustments.

Projecting through the cover 10 are a plurality of standpipes. Each of the standpipes mounts through a rubber seal 11, only one of which is shown. The seals 11 prevent the migration of external contaminants between each standpipe and the cover 10. The seals 11 are cast into the cover during the pouring of the cover/tank assembly 30. Although cast-in-place seals are preferred, an appropriate packing material may also be forced into any gap between each standpipe and a formed aperture in the tank cover 10, such as for an alternative tank construction described below.

Of the various standpipes which project from the cover 10, respective pairs of standpipes 12 and 14 serve as liquid fill ports. One pair is mounted at each end of the tank 6 and each pipe communicates with the tank interior. Liquid is normally admitted via the pipes 12, while the pipes 14 serve as fill vents. The tank 6 provides a single storage compartment, although may include one or more internal partition walls to define separate storage cavities which are independently accessible via the separate sets of standpipes 12, 14.

A spill containment collar or manhole 15 is typically secured to each of the fill pipes 12 that service each liquid storage compartment. The right vent pipe 14 includes a removeable cap or cover 13 which is readily removed when the tank 6 is filled. As depicted, a single spill collar 15 is shown and only the right set of the two sets of fill ports 12, 14 is used. The extra fill pipe 12 and vent pipe 14 at the left end of the vault 4 are capped with threaded covers 17. The collar 15 is commercially available from a number of vendors and serves to collect and re-direct any spillage that occurs during filling of the tank 6.

A pair of redundant standpipes 16 serve as liquid level monitoring ports. A level gauge or conventional liquid meter 9, compatible with the stored liquid, is normally mounted to each of the pipes 16 which service each liquid compartment. Alternatively, the standpipes 16 may merely facilitate visual inspection of the tank interior with the aid of appropriately directed illumination. For the depicted single chamber tank 6, the left standpipe 16 is covered with a cap 17.

A center mounted standpipe 18 serves as an emergency vent port and may include a cover 19. Depending upon the contained liquid, the cover 19 may be open to the ambient environment. More typically the cover 19 comprises a suitable pressure relief valve or blow-off valve which relieves internal tank pressure at one or more pre-set limits.

A standpipe 20 is mounted to one corner of the cover 10 and extends into the interior of the vault base 8 to facilitate leak detection. Leakage may be detected through visual inspection of the base interior or upon inserting appropriate test equipment, such as a dip stick into the space between the tank 6 and vault base 8. Leakage is detectable due to provided sidewall clearances and the presence of a liquid impervious membrane or liner 22 which lines the interior of the vault base 8.

Figure 4:
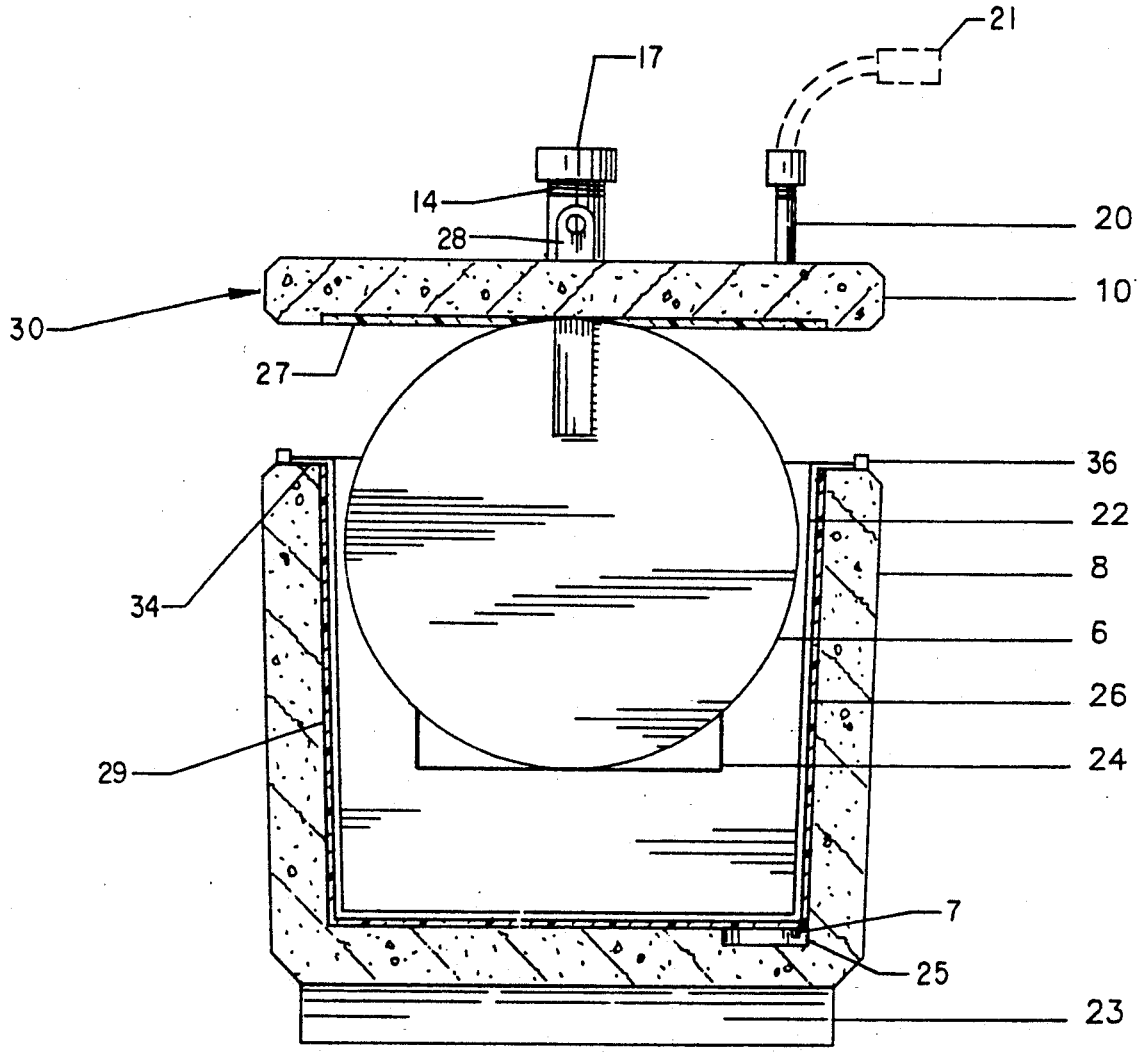
FIG. 4 is a side elevation drawing shown in exploded assembly of an alternative vessel which includes a separate condensate sump.

Referring also to FIG. 4, a second standpipe 20 or alternatively the standpipe 20 of FIG. 1 may be secured to the cover 10 to communicate with a sump pit 25 formed into the bottom of the base 8. Upon coupling a pump or siphon 21 (shown in dashed line) to each standpipe 20 or to a conduit inserted through one or more of the standpipes 20, leakage and/or condensate can be removed from the base 8. Removal of liquids from the sump 25 requires routing a suitable conduit 7 beneath the liner 22.

The vault base 8 is monolithically cast in a singe pour and includes a number of reinforcement members 31. The interior surface 29 of the base 8 is sloped to direct any leakage or condensate to one end, where the pump 25 is typically contained. Attention is also directed in this regard to FIG. 2.

Integrally poured with the vault base 8 are a number of support feet 23 which raise the vault base 8 above the ground surface. Air is thereby allowed to circulate around the vault 2, which minimizes the formation and collection of potential condensates within the vault 2.

Figure 3:
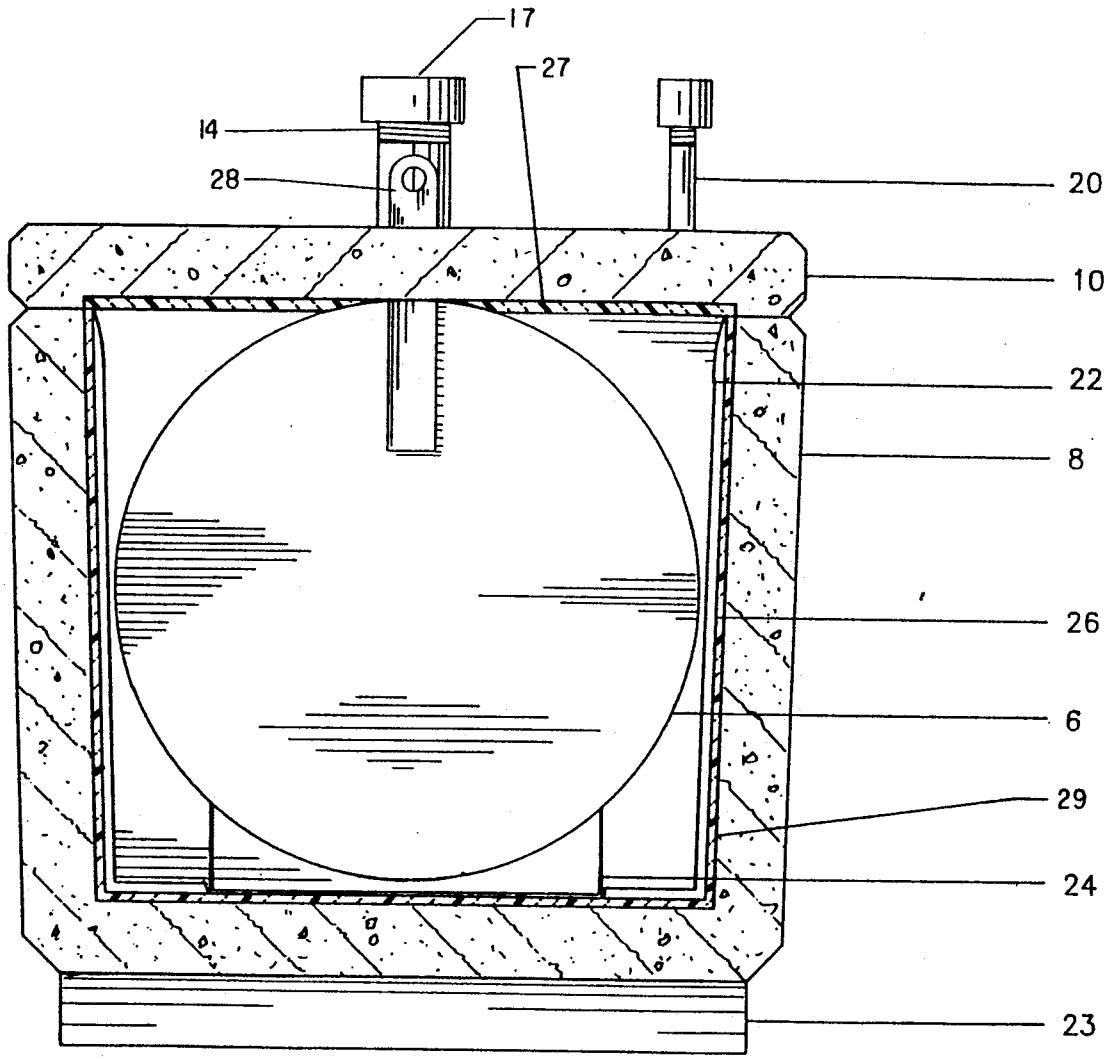
FIG. 3 is a right side elevation drawing taken along section lines 3—3 of FIG. 1.

Multiple cradles 24 (reference FIGS. 2 and 3 are secured to the tank 6 and support the tank 6 above) the bottom of the vault base 8. Presently the cradles 24 are attached to the tank 6 although may be poured as part of the vault base 8. If poured as part of the base 8, channels are provided to prevent collection of liquid or condensate, except adjacent the standpipes 20.

A thermal insulative liner 26 is adhesively bonded to the respective interior surfaces 27 and 29 of the cover 10 and vault base 8. Thermal transfer and the formation of condensation within the vault 2 are thereby minimized.

Also secured to the cover 10 are a number of lifting eyelets 28. The eyelets 28 facilitate removal of the tank-/cover assembly 30, which eyelets in the preferred construction 2 are bonded to the tank 6 as part of the assembly 30. Otherwise, the cover 10 and tank 6 are contained to each other via bored weldments 31 that are welded to the tank 6 and integrated into the network of reinforcing members 32 that are cast into the cover 10. Thus, upon pouring the cover concrete, the cover 10 and tank 6 become a single assembly 30.

With particular attention next directed to FIGS. 2 through 4, more of the details of the interior of the vault 2 and the construction of the assembly are apparent. Particularly apparent from the views of FIGS. 3 and 4 is the positioning of the liners 26 and 22. The liner 26 comprises a layer of foam insulation which is adhesively bonded to the interior vault surfaces 27 and 29. Typically a polystyrene or polyether foam having a thickness in the range of one to two inches is provided. Such material insulates the vault interior and concrete to minimize condensation.

Condensation can arise in humid environments and reduce the useful life of the vault 2. That is, water which collects above the liner 22 can induce tank corrosion, if left unattended. Water which collects below the liner 22 can reduce the efficiency of the insulator 26. The interior sidewalls and bottom of the vault base 8 are sloped to direct liquids to one end, where the siphon or pump assembly 21 can remove the collected liquid, reference FIG. 2 and 4. If a sump 25 is provided, it is formed at the lowest end of the base.

The liquid impermeable membrane or liner 22 is constructed of a rubber or polyvinyl sheeting and is mounted between the insulation 26 and tank 6. The membrane 22 constitutes a single sheet of material. The membrane 22 is mounted to cover the entire bottom of the vault base 8 and to extend up the side walls to an exposed peripheral edge 34 of the base 8. The membrane 22 is sealed to the edge 34 via a suitable adhesive and is further restrained to the base 8, upon setting the cover 10 onto the edge 34 (reference FIGS. 2 and 3).

A vapor tight seal is obtained between the cover 10 and base 8 by securing an elastomer seal 36 to the edge 34, prior to setting the cover 10. The seal 36 may alternatively be bonded into the base 8 during casting. The seal 36 is presently constructed of an elastomer stripping material which has an adhesive backing and which is secured adjacent or along the edge of the membrane 22 at the edge 32.

In contrast to monolithic or non-modular containment vessels, a primary advantage of the present vault assembly 2 is the ability to replace one or more portions of the assembly 2. For example and depending upon the setting within which the vault 2 is found, only the vault base 8 may be damaged and require replacement. Such replacement is readily achieved with the vault 2, upon merely lifting the cover/tank assembly 30 and inserting the removed assembly 30 into a new vault base 8. Alternatively, should the tank 6 rupture or corrode, tank replacement can be readily effected through replacement with a new cover/tank assembly 30.

Although the cover 10 is molded in place to the tank 6, via the lifting eyes 28 and weldments 31, the cover 10 can be separately formed to include a number of apertures of slightly larger size than the standpipes. In such an instance and with removal of any caps 15, 17, meters 19 or the like secured to the standpipes, the cover 10 and tank 6 may be separately replaced. Such a construction is not, however, preferred for a number of reasons.

A principle reason is that by molding the cover 10 and tank 6 as a single assembly 30, the assembly 30 and base 8 self-align to one another with the fitting of one to the other. That is, the tank 6, standpipes 12, 14, 16, 18 and 20, and cradles 24 are pre-aligned relative to the cover 10 and to the vault base 8. Thus, it is not necessary to either rotate the tank 6 or shift the tank 6 laterally or longitudinally within the base 8 to provide a proper fit between the cover 10 and base 8. An integral assembly 30 also serves to prevent flotation and shifting of the tank 6, if condensation or leakage collects in the vault base 8.

To further alleviate any concern of flotation, separate anchor bolts can be mounted to the base 8 to project through the cover 10 and mate with nut fasteners. Cover straps 38 may also be wrapped over the cover 10 to mate with bolts provided at the base 8.

While the present invention has been described with respect to its presently preferred construction and various considered modifications and improvements thereto, still other constructions may be suggested to those skilled in the art. Accordingly the following claims should be interpreted to include all those equivalent embodiments within the spirit and scope thereof.

What is claimed is:

1. Liquid containment apparatus comprising:

(a) a concrete base having a bottom wall and a plurality of sidewalls which project from the bottom wall to define an open cavity;

(b) tank means for containing a liquid within a storage compartment and including access means for communicating with said storage compartment and further including attachment means for making a permanent coupling to said tank means; and (c) a concrete cover which is removably supported to said sidewalls to cover said cavity, wherein said access means projects through said cover, and wherein said cover includes a plurality of reinforcement members which are integrally cast into said cover and coupled to said attachment means such that such cover and tank means are permanently aligned and bound to one another and removable as a unit from said base.

2. Apparatus as set forth in claim 1 wherein interior surfaces of said base and cover are lined with a thermal insulation.

3. Apparatus as set forth in claim 2 wherein said base includes a liquid impermeable membrane, which membrane terminates at a peripheral edge of said sidewalls, whereby liquid is contained in the base in the event of tank leakage or spillage.

4. Apparatus as set forth in claim 3 including sump means for removing liquid condensate or spillage collecting in said base.

5. Apparatus as set forth in claim 3 wherein interior surfaces of said sidewalls of the base vertically taper to define an open cavity of greater circumference at said peripheral edge than at the bottom wall, and wherein the interior surface of the bottom wall is sloped to one end of the base.

6. Apparatus as set forth in claim 5 including a plurality of cradles which support said tank means above the bottom of said base.

7. Apparatus as set forth in claim 1 wherein said tank means comprises a permanently enclosed metal container and includes a plurality of standpipes which project from said container through said cover and wherein said cover includes seal means for sealing the juncture between each standpipe with the cover.

8. Apparatus as set forth in claim 7 including means for sealing the juncture between said cover and said base.

9. Apparatus as set forth in claim 1 wherein said attachment means comprises a plurality of bored projections which extend from said tank and said plurality of reinforcement members are mounted to extend through openings provided at said projections.

10. Apparatus as set forth in claim 9 including means for lifting said cover, which lifting means is secured to said tank means and extends through said cover.

11. Liquid containment apparatus comprising:

(a) a concrete base having an integrally molded bottom wall and a plurality of sidewalls which project from the bottom wall to define an open cavity;

(b) tank means for containing a liquid within a storage compartment and including a plurality of standpipes which project from said tank and communicate with said storage compartment and a plurality of projections which include a bore, and which extend from said tank;

(c) a concrete cover which is removeably supported from said sidewalls to cover said cavity, wherein said cover includes a plurality of reinforcement members which are mounted to extend through said plurality of bored projections and which reinforcement members and projections are permanently cast into said cover such that said cover and tank means are permanently aligned and bound to one another and removable as a unit from said base.

12. Apparatus as set forth in claim 11 wherein said base and cover include means for thermally insulating the interior surfaces of said base and cover.

13. Apparatus as set forth in claim 12 including a liquid impermeable membrane mounted within said between said tank means and base and wherein peripheral edges of said membrane are secured to a peripheral edge of said sidewalls where said cover is supported.

14. Apparatus as set forth in claim 13 wherein interior surfaces of said sidewalls of the base vertically taper to define an open cavity of greater circumference at a peripheral edge at the open top than at the bottom wall, and wherein the interior surface of the bottom wall is sloped to one end of the base.

15. Apparatus as set forth in claim 13 including means for removing liquids from said base which collect above and below said membrane.

16. Apparatus as set forth in claim 13 wherein said base includes a plurality of external support feet which project from the bottom of said base to support said base above a support surface and further includes means for supporting said tank above the bottom wall.

17. Apparatus as set forth in claim 16 wherein said tank support means comprises a plurality of cradles which are secured to said tank.

18. Apparatus as set forth in claim 11 including seal means mounted to a peripheral edge of the open top of said base for sealing the juncture between said cover and said base.

19. Apparatus as set forth in claim 11 wherein said cover includes a plurality of seals which are cast to said cover and surround each of said standpipes.

* * * * *